United States Patent [19]

Hirsbrunner

[11] 4,095,504

[45] Jun. 20, 1978

[54] ROTARY VALVE FOR BRASS WIND INSTRUMENTS

[76] Inventor: Peter Hirsbrunner, Dorfgasse, Sumiswald, Switzerland

[21] Appl. No.: 781,974

[22] Filed: Mar. 28, 1977

[30] Foreign Application Priority Data

Mar. 30, 1976 Germany ..... 2613554

[51] Int. Cl.[2] ..... G10D 9/04

[52] U.S. Cl. ..... 84/390; 84/452 P

[58] Field of Search ..... 84/387–394; 84/452 P

[56] References Cited

U.S. PATENT DOCUMENTS 3,835,748 9/1974 Olson ..... 84/388

FOREIGN PATENT DOCUMENTS 2,249,984 4/1974 Germany ..... 84/452 P

*Primary Examiner*—L. T. Hix
*Assistant Examiner*—Benjamin R. Fuller
*Attorney, Agent, or Firm*—Salter & Michaelson

[57] ABSTRACT

A rotary valve for a wind brass instrument comprises, as usual, a housing having a cylindrical wall with four duct connecting pieces fixed thereto about the circumference thereof. It also comprises a rotating member including a continuous metal shaft with end portions forming journals, a middle portion having a core element made of plastic material which does not swell in a wet environment, a metal jacket snugly fitted upon the core element and forming a fluid-tight joint with the cylindrical wall of the housing, and one or more pins engaged in respective bores extending diametrically through the jacket, core and shaft.

1 Claim, 2 Drawing Figures

ROTARY VALVE FOR BRASS WIND INSTRUMENTS

This invention relates to a rotary valve for a brass wind instrument, of the type wherein a housing, having a cylindrical wall with four duct connecting pieces fixed thereto about the circumference thereof, accommodates a rotating member including a middle portion and two journals by means of which this member is rotatingly but undisplaceably mounted in the housing, one of the journals projecting from the housing for enabling operation of the rotating member, and the middle portion having a substantially cylindrical exterior surface forming a fluid-tight joint together with the housing wall and having two recesses situated on opposite sides of the longitudinal axis of the valve for causing the connecting pieces to communicate in pairs in both of two positions of rotation of the rotating member separated by 90°.

The manufacture of rotary valves (also called "cylinder valves") for brass instruments has not experienced any technical development for the past 20 years. On the contrary, designs which were considered second-class before World War II are being offered as first-class today. It would appear that the manufacture of light, soldered rotating members for rotary valves has become too complicated and too expensive. Rotating members which are cast or lathe-turned from bars are used nowadays almost without exception.

Rotary valves with such rotating members may well suffice for amateur musicians, but a professional musician is obliged to have lighter and quicker rotating members in his instrument in order to meet today's requirements. Tuba players in particular having been calling for a better solution for years now.

It is therefore an object of this invention to provide an improved rotary valve of the type initially described in which the rotating member is considerably lighter—typically about 50% lighter—than the usual rotating members made from bar stock, but which is not significantly more expensive to manufacture than these bar-stock members. The weight reduction is not primarily important for reducing the overall weight of the instrument, which does, after all, comprise a number of rotary valves, but rather as regards the inertia. The favorable effects of reducing the inertia are twofold, viz., the amount of effort required for operation is directly reduced as a result of the reduction of inertia, and it is indirectly reduced because the strength of the return spring forming part of the operating means may be lessened to the same extent for just as quick a return rotation.

To this end, in the rotary valve according to the present invention, the improvement comprises a rotating member including a continuous metal shaft having end portions forming the journals, a middle portion having a core element made of a plastic material which does not swell in a wet environment and mounted upon the shaft, a metal jacket being snugly fitted upon the core element and forming the exterior surface of the middle portion, one or more radial or diametral bores piercing the middle portion, and one or more pins engaged in respective bores for securing the jacket to the core element.

Among the advantages of this design is the possibility of choosing for the shaft a material having good sliding properties in the bearing caps, and for the jacket, utilizing pipes made of an alloy which is particularly resistant to corrosion caused by salivary acid.

A completely fitted valve rotating member intended for a tuba and having air passages of 19.5 mm. in diameter weighs 100–110 g. in the usual current design. A valve rotating member of the novel design according to the invention, on the other hand, of the same size, weighs 45–55 g. depending upon the jacket thickness chosen.

A preferred embodiment of the invention will now be described in detail with reference to the accompanying drawing, in which.

Figure 1:
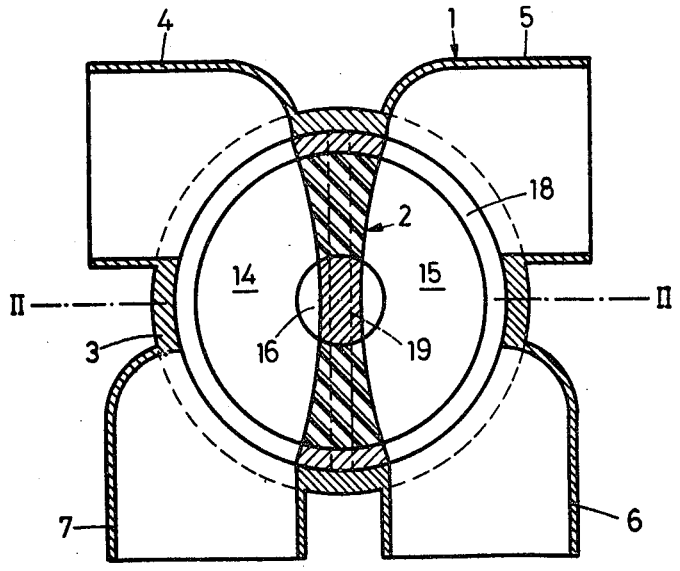
FIG. 1 is a cross-section taken on the line I—I of FIG. 2.
Figure 2:
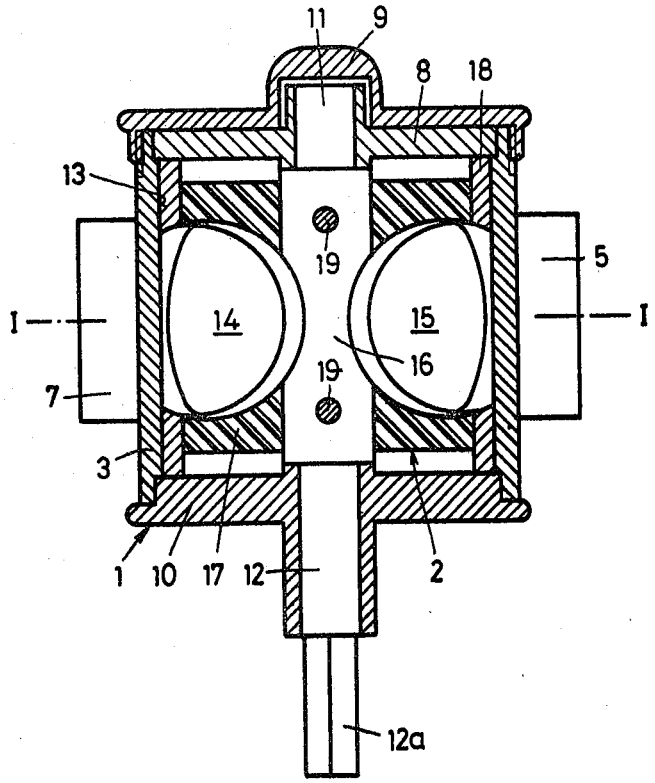
FIG. 2 is a longitudinal section taken on the line II—II of FIG. 1.

The illustrated rotary valve for a brass instrument, e.g., a tuba, is composed in a conventional manner of a housing 1 and a rotating member 2. The housing 1 is no different from that of customary designs and has a wall 3 with four duct connecting pieces 4, 5, 6, and 7 soldered thereto about its circumference, an immovably inserted bearing part 8, a cap 9 screwed on at one end, and a bearing part 10 soldered fast at the other end.

The rotating member 2 comprises—as in prior art designs—two journals 11, 12 by means of which it is rotatingly but non-displaceably mounted in the housing 1, and a middle portion having an exterior surface 13 which forms a fluid-tight joint together with the inner suface of the housing wall 3; the surface 13 is substantially cylindrical, although in practice it will be slightly conical in order to enable highly accurate fitting. The journal 12 includes a projecting portion **12*a* in the form of a square for connection to conventional operating means. The middle portion further includes two recesses 14, 15 which are situated on opposite sides of the longitudinal axis and which cause the four connecting pieces 4, 5, 6, 7 to communicate in pairs in both of two positions of rotation of the rotating member 2** separated by 90°.

The novel aspects of the structural design of the rotating member 2 will now be described.

The journals 11, 12 are end portions of a continuous metal shaft 16. Seated fast upon the shaft 16 is a core element 17 of the middle portion, made of plastic material which does not swell in a wet environment. Seated fast upon the core element 17 is a metal jacket 18 of the middle portion, the exterior surface 13 being that of the jacket 18. Furthermore, at least one pin 19 is provided (in the embodiment under discussion there are two) which fits snugly in a diametral (or radial) bore in the middle portion of the rotating member 2. This additional pinning is necessary because when the rotating member 2 is fitted in the housing 1, the member 2 is first lightly tapped with a hammer; and because for dismantling purposes, after removal of the cap 9, the end face of the journal portion **12*a* is similarly tapped with a hammer in order to knock the bearing part 8 out of the housing wall 3. The recesses 14 and 15 are produced in the core element 17 and the jacket 18** by boring operations.

In a typical embodiment, the shaft 16 is of nickel silver, the core element 17 of the middle portion is made of polypropylene or polyethylene because these plastics do not swell in a wet environment and because their coefficient of thermal expansion differs little from that of brass, for example, and the jacket 18 is made either of brass, of nickel silver, or of stainless steel; this last-mentioned part may naturally be produced from a section of pipe during manufacture of the valve.

What is claimed is:

1. In a rotary valve for a brass wind instrument of the type wherein a housing, having a cylindrical wall with four duct connecting pieces fixed thereto about the circumference thereof, accommodates a rotating member including a middle portion and two journals by means of which said member is rotatingly but undisplaceably mounted in said housing, one of said journals projecting from said housing for enabling operation of said rotating member, and said middle portion having a substantially cylindrical exterior surface forming a fluid-tight joint together with said wall of said housing and having two recesses situated on opposite sides of the longitudinal axis of said valve for causing said connecting pieces to communicate in pairs in both of two positions of rotation of said rotating member separated by 90°, the improvement comprising a said rotating member including:

a continuous metal shaft having end portions forming said journals, a said middle portion having a core element made of a plastic material which does not swell in a wet environment and mounted upon said shaft, a metal jacket being snugly fitted upon said core element and forming said exterior surface, one or more radial or diametral bores piercing said middle portion, and one or more pins engaged in respective said bores for securing said jacket to said core element.

* * * * *